US010355393B2

(12) United States Patent
Yi et al.

(10) Patent No.: US 10,355,393 B2
(45) Date of Patent: Jul. 16, 2019

(54) SEALED REAR-LOADED ELECTRICAL CONNECTOR HOUSINGS, ASSEMBLIES, AND SYSTEMS

(71) Applicant: TE CONNECTIVITY CORPORATION, Berwyn, PA (US)

(72) Inventors: Chong Hun Yi, Mechanicsburg, PA (US); Matthew Morrison, Lemoyne, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/804,467

(22) Filed: Nov. 6, 2017

(65) Prior Publication Data

US 2019/0140389 A1 May 9, 2019

(51) Int. Cl.

*H01R 13/52* (2006.01)
*H01R 13/436* (2006.01)
*H01R 33/965* (2006.01)

(52) U.S. Cl.

CPC ..... *H01R 13/5202* (2013.01); *H01R 13/4362* (2013.01); *H01R 13/5205* (2013.01); *H01R 13/52* (2013.01); *H01R 13/5213* (2013.01); *H01R 13/5219* (2013.01); *H01R 13/5221* (2013.01); *H01R 33/965* (2013.01)

(58) Field of Classification Search

CPC ..... H01R 13/5202; H01R 13/5205; H01R 13/5221; H01R 13/5219; H01R 33/965; H01R 13/52; H01R 13/4362; H01R 13/5213

USPC ..... 439/271, 587, 588, 589, 752

See application file for complete search history.

(56) References Cited

U.S. PATENT DOCUMENTS

| | | | |
|---|---|---|---|
| 4,684,187 | A | 8/1987 | Rudy, Jr. et al. |
| 5,707,251 | A | 1/1998 | Sakai et al. |
| 6,045,404 | A | 4/2000 | Myer |

(Continued)

FOREIGN PATENT DOCUMENTS

| | | | |
|---|---|---|---|
| EP | 2306595 A1 | | 4/2011 |
| JP | 58141584 U | * | 9/1983 |
| JP | S58141584 U | | 9/1983 |

OTHER PUBLICATIONS

International Search Report and Written Opinion issued for corresponding PCT Application PCT/IB2018/058057 dated Jan. 7, 2019.

*Primary Examiner* — Abdullah A Riyami
*Assistant Examiner* — Justin M Kratt

(57) ABSTRACT

Sealed rear-loaded electrical connector housings, assemblies and systems are disclosed. The housing includes a connector having a TPA cap including an aperture and a TPA leg, a rear wire seal including a wire aperture and a TPA leg aperture, and a housing including a positioning surface. In a pre-loaded configuration, the rear wire seal is inserted into the housing, and the TPA cap is mounted onto the housing with the aperture aligned with the wire aperture and the TPA leg disposed at least partially in the TPA leg aperture. In a loaded configuration, the TPA cap is mounted deeper onto and locked in place on the housing, and the TPA leg passes through the TPA leg aperture forming a water-tight seal with the TPA leg aperture. The assembly includes the connector and a wire-crimped terminal disposed in the connector. The system includes a first connector and a second connector.

20 Claims, 7 Drawing Sheets

(56) References Cited

U.S. PATENT DOCUMENTS

| | | | | |
|---|---|---|---|---|
| 6,398,585 | B1 | 6/2002 | Fukuda | |
| 6,514,098 | B2 | 2/2003 | Marpoe, Jr. et al. | |
| 6,755,688 | B2 | 6/2004 | Hall et al. | |
| 7,029,328 | B1 | 4/2006 | Mckenzie et al. | |
| 7,077,701 | B2 | 7/2006 | Martin | |
| 7,625,251 | B2 | 12/2009 | Martin et al. | |
| 8,408,950 | B2 | 4/2013 | Jeon et al. | |
| 2005/0245130 | A1* | 11/2005 | Shiga ..... | H01R 13/5208<br>439/587 |
| 2015/0140847 | A1* | 5/2015 | Kanemura ..... | H01R 13/4368<br>439/259 |

* cited by examiner

SEALED REAR-LOADED ELECTRICAL CONNECTOR HOUSINGS, ASSEMBLIES, AND SYSTEMS

FIELD OF THE INVENTION

The present invention is directed to electrical connector housings, assemblies and systems. More particularly, the present invention is directed to electrical connector housings, assemblies and systems which are rear-loaded and sealed to form a water-tight connection pocket.

BACKGROUND OF THE INVENTION

Electrical connectors are designed to assure satisfactory electrical contacts. Two distinct challenges, amongst others, are known to inhibit such satisfactory electrical contacts. First, the positioning of contact terminals within the electrical connector may not be ideal, which may result in a failure of electrical contact, intermittent electrical contact or an electrical contact which degrades or fails over time. Second, sufficient exposure of the contact terminals with a conductive fluid such as non-resistive water may short the electrical contact.

In order to address the positioning of contact terminals within electrical connectors, terminal position assurance (TPA) features have been developed, which lock the terminals in positions suitable for full electrical contact. TPA features known in the art may be front-loaded or rear-loaded, each of which configuration presents its own advantages and disadvantages. By way of example, rear-loaded TPA connectors, in addition to assuring proper position, may also support the terminals disposed within the connector, ensuring the primary locking finger of the housing cavity is properly positioned, thereby increasing the assurance of the positions and also may provide additional retention strength.

Preventing shorting of the electrical contact by conductive fluid requires protecting the contact terminals from exposure to conductive fluids. In a typical electrical connection, there are at least three pathways for exposure—the interface of the wires for the terminals of the plug connector with the housing, the interface of the wires for the terminals of the receptacle connector with the housing and the interface between the plug connector and the receptacle connector.

In order to achieve both TPA and prevent shorting from conductive fluids, each of the three primary routes for exposure must be suitably sealed without interfering with the TPA feature. Interface seals between plug connectors and receptacle connectors are known in the art positioned so as not to interfere with TPA devices for either front-loaded or rear-loaded electrical connector housings. Additionally, seals for the interface of wires for the terminals of receptacle connectors and plug connectors are known in the art for front-loaded TPA devices and are possible without interfering with the operation of the TPA devices because the front-loaded TPA devices are removed from the interface of the wires with the housings. However, known seals for the interface of wires for the terminals of receptacle connectors and plug connectors prevent operation of rear-loaded TPA devices because the rear-loaded TPA devices and seals for the wires must occupy the same space.

BRIEF DESCRIPTION OF THE INVENTION

In an exemplary embodiment, a sealed rear-loaded electrical connector assembly includes a connector housing. The housing has a positioning surface adapted to support and orient wire-crimped terminals positioned in the housing. A TPA cap is provided on the housing. The TPA cap has apertures adapted to receive the wire-crimped terminals and TPA legs. The TPA legs have wire support surfaces adapted to support wires of the wire-crimped terminals. The TPA legs extend from an interior surface of the TPA cap. A rear wire seal is provided between the housing and the TPA cap. The rear wire seal has wire apertures adapted to receive the wire-crimped terminals and TPA leg apertures adapted to receive the TPA legs. In a pre-loaded configuration, the rear wire seal is positioned between the housing and the TPA cap, the TPA cap is mounted onto the housing with the apertures of the TPA cap aligned with the wire apertures of the rear wire seal and the TPA legs are disposed at least partially in the TPA leg apertures. In a fully loaded configuration, the TPA cap is mounted deeper onto and locked in place on the housing, and the TPA legs pass through the TPA leg apertures forming a water-tight seal with the TPA leg apertures.

In another exemplary embodiment, a sealed rear-loaded electrical connector assembly includes a connector housing which has a positioning surface adapted to support and orient keyed wire-crimped terminals positioned in the housing. A TPA cap is provided on the housing. The TPA cap has apertures adapted to receive the wire-crimped terminals and TPA legs. The apertures are adapted to receive the keyed wire-crimped terminals. The apertures are keyed to cooperate with respective terminals of the keyed wire-crimped terminals. The TPA legs have wire support surfaces adapted to support wires of the wire-crimped terminals. The TPA legs extend from an interior surface of the TPA cap. A rear wire seal is provided between the housing and the TPA cap. The rear wire seal has wire apertures adapted to receive the wire-crimped terminals and TPA leg apertures adapted to receive the TPA legs. In a fully loaded configuration, the TPA legs pass through the TPA leg apertures forming a water-tight seal with the TPA leg apertures, the wire-crimped terminals are locked in place by locking surfaces of the TPA legs directly abutting the wire-crimped terminals, the wires of the wire-crimped terminals directly contact the wire support surfaces and the wires forms wire water-tight seals with the wire apertures.

In another exemplary embodiment, a sealed rear-loaded electrical connector assembly includes a connector housing. The housing has a positioning surface adapted to support and orient wire-crimped terminals positioned in the housing. A TPA cap is provided on the housing. The TPA cap has apertures adapted to receive the wire-crimped terminals and TPA legs. The TPA legs have wire support surfaces adapted to support wires of the wire-crimped terminals. The TPA legs extend from an interior surface of the TPA cap. The TPA legs widen as the TPA legs extend from the interior surface. A rear wire seal is provided between the housing and the TPA cap. The rear wire seal has wire apertures adapted to receive the wire-crimped terminals and TPA leg apertures adapted to receive the TPA legs. In a fully loaded configuration, the TPA legs pass through the TPA leg apertures forming a water-tight seal with the TPA leg apertures, the wire-crimped terminals are locked in place by locking surfaces of the TPA legs directly abutting the wire-crimped terminals, the wires of the wire-crimped terminals directly contact the wire support surfaces and the wires forms wire water-tight seals with the wire apertures.

Other features and advantages of the present invention will be apparent from the following more detailed description.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
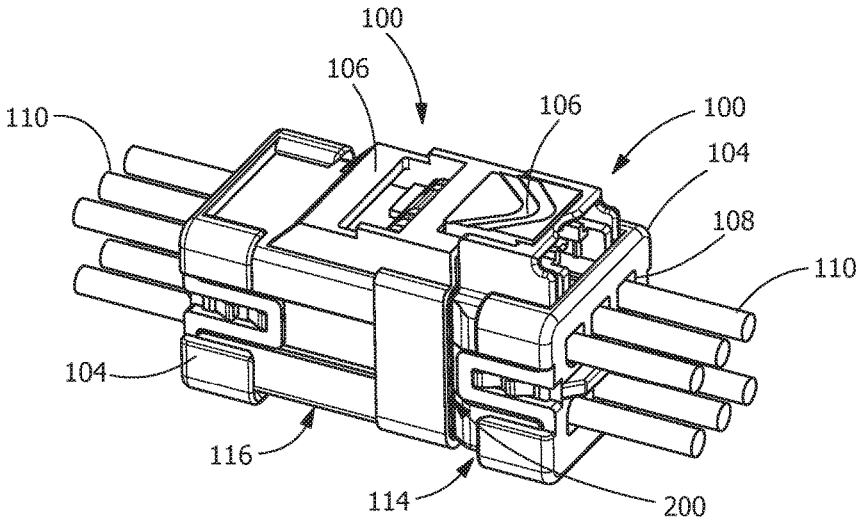
FIG. 1 is a perspective view of a sealed rear-loaded electrical connector housing assembly system in a mated configuration, according to an embodiment of the disclosure.

Provided are electrical connector housings, assemblies and systems. Embodiments of the present disclosure, for example, in comparison to concepts failing to include one or more of the features disclosed herein, improve water-resistance while maintaining rear-loaded TPA, maintain TPA and water-tight sealing while passing through rear ganged seals, decrease cost and complexity which would be needed for individually sealed wires, decreases cost and complexity for sealing cavities which are not used, or combinations thereof.

Referring to FIGS. 1-11, in one embodiment, a sealed rear-loaded electrical connector assembly 100, a TPA cap 104, a rear wire seal 300 and a housing 106. The TPA cap 104 includes an aperture 108 adapted to receive a wire-crimped terminal 304, and a TPA leg 306 having a wire support surface 308 adapted to support a wire 110 of the wire-crimped terminal 304. The TPA leg 306 extends from an interior surface 310 of the TPA cap 104. The rear wire seal 300 includes a wire aperture 312 adapted to receive the wire-crimped terminal 304, and a TPA leg aperture 314 adapted to receive the TPA leg 306. The housing 106 includes a positioning surface 900 on which the terminal 316 of the wire-crimped terminal 304 sits or rests. The positioning surface 900 is adapted to support and orient the terminal 316 of the wire-crimped terminal 304. The connector assembly 100 may be a plug connector 114 or a receptacle connector 116.

Figure 5:
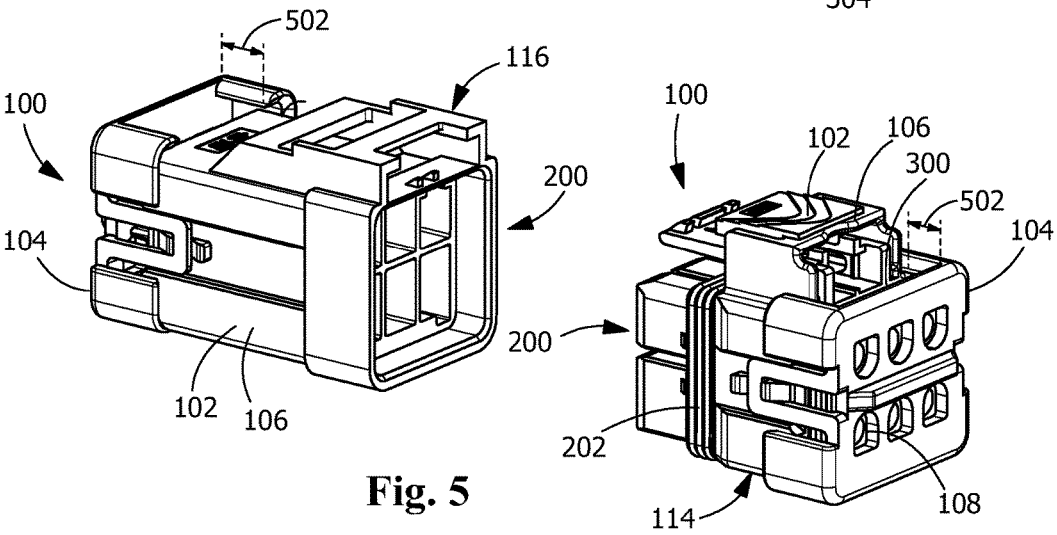
FIG. 5 is a perspective view of the plug connector of FIG. 1 in a pre-loaded configuration and the receptacle connector of FIG. 1 in a pre-loaded configuration, according to an embodiment of the disclosure.
Figure 6:
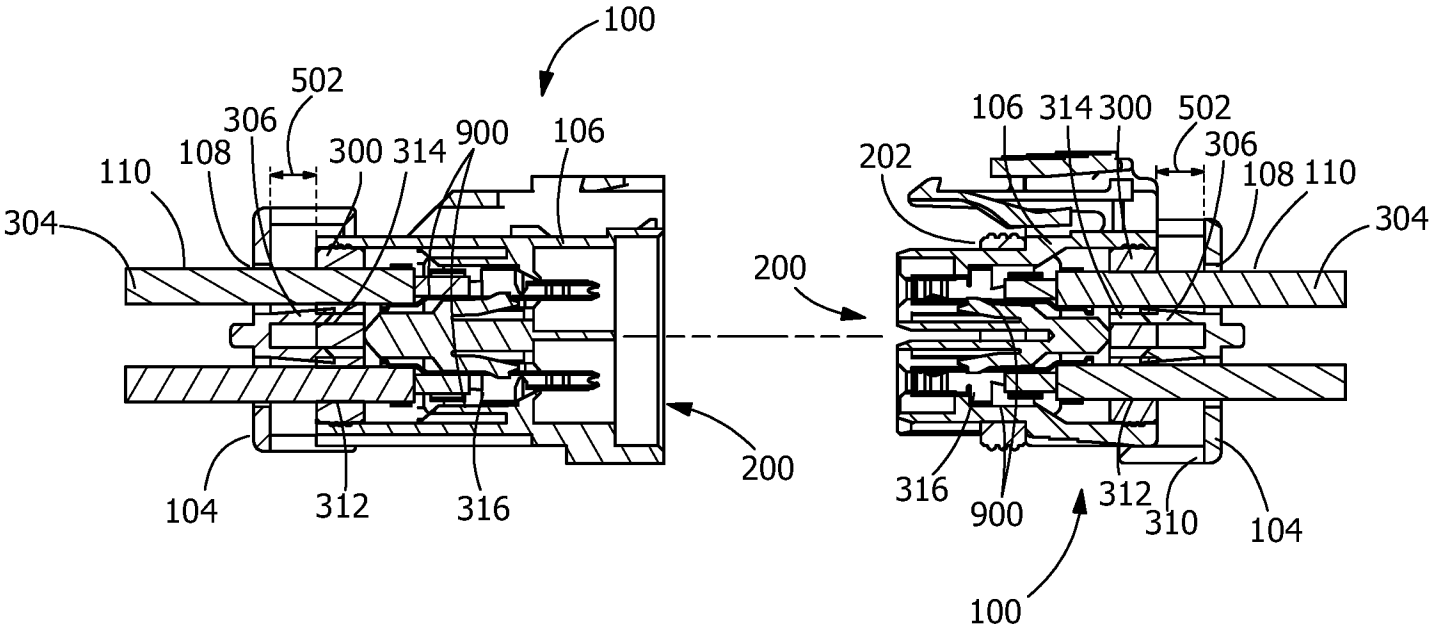
FIG. 6 is a cross-sectional view of the sealed rear-loaded electrical connector housing assembly system of FIG. 1 in a pre-loaded configuration while disconnected, according to an embodiment of the disclosure.

In a pre-loaded configuration, as shown in FIGS. 5 and 6, the rear wire seal 300 is inserted into the housing 106, the TPA cap 104 is mounted onto the housing 106 with the aperture 108 aligned with the wire aperture 312, the TPA leg 306 is disposed at least partially in the TPA leg aperture 314 and there is a distance 502 between the interior surface 310 and the rear wire seal 300 (as shown in FIG. 6). The distance 502 in the pre-loaded configuration may be any suitable distance 502, including, but not limited to, a distance between about 2 mm and about 6 mm, alternatively between about 2 mm to about 4 mm, alternatively between about 3 mm to about 5 mm, alternatively between about 4 mm to about 6 mm, alternatively between about 3.5 mm to about 4.5 mm, alternatively about 4 mm.

Figure 2:
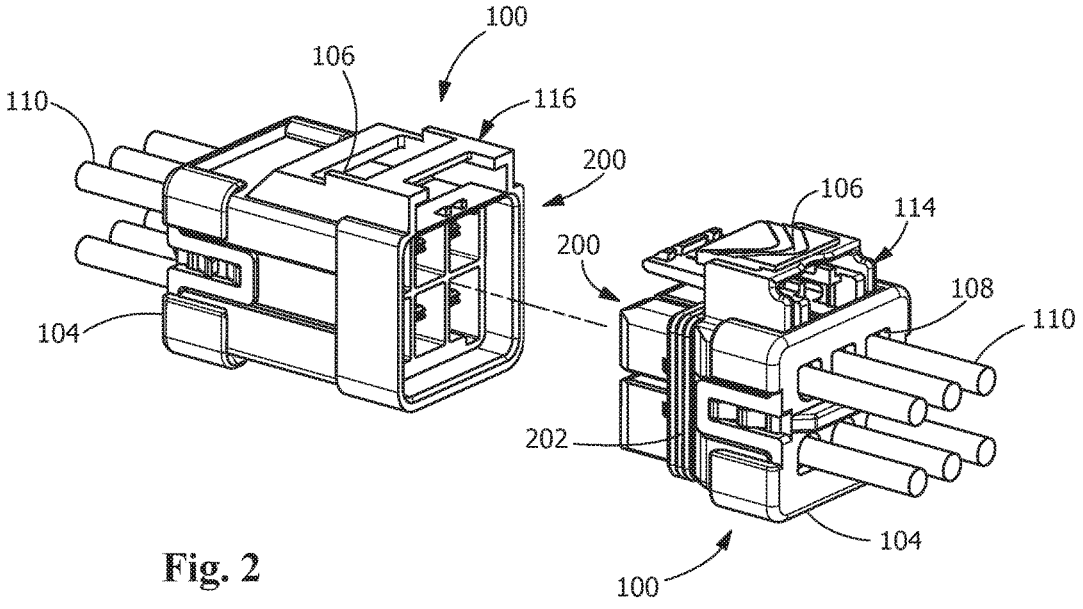
FIG. 2 is a perspective view of the sealed rear-loaded electrical connector housing assembly system of FIG. 1 while disconnected, according to an embodiment of the disclosure.
Figure 7:
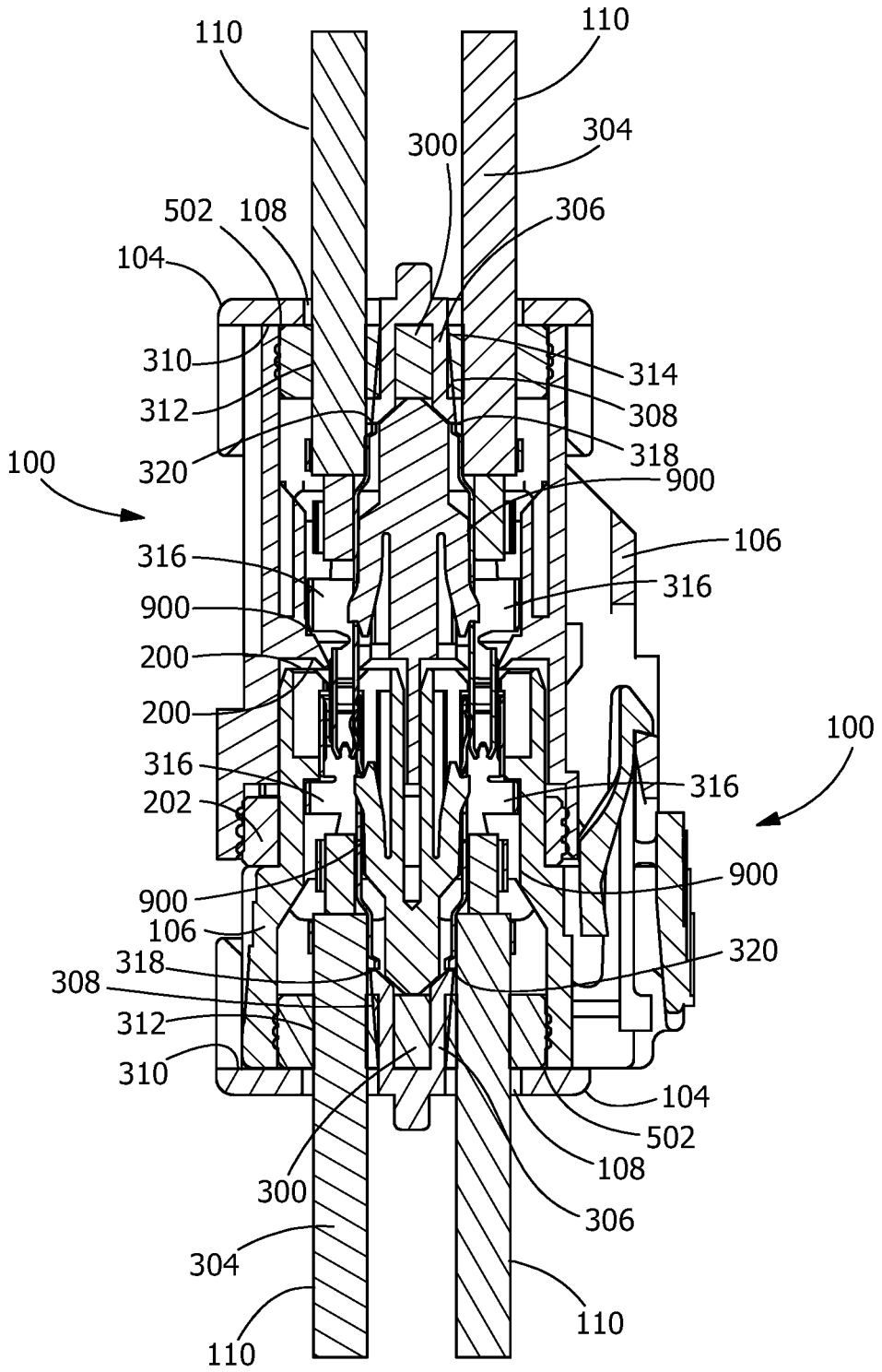
FIG. 7 is a cross-sectional view of the sealed rear-loaded electrical connector housing assembly system of FIG. 1 in a loaded configuration, according to an embodiment of the disclosure.
Figure 8:
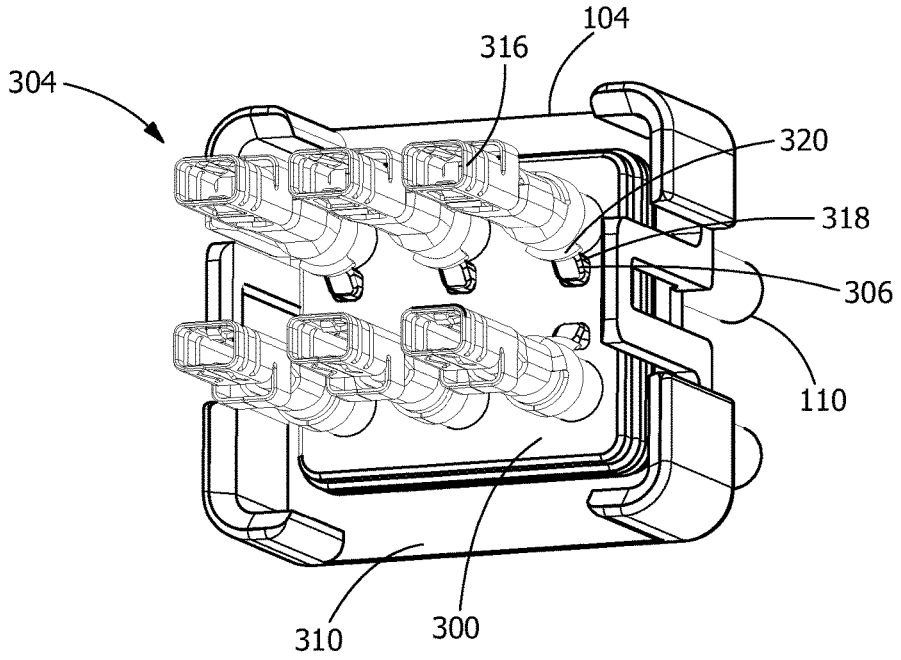
FIG. 8 is a perspective view of an assembled wire-crimped terminal, TPA cap and rear wire seal, according to an embodiment of the disclosure.

When assembled, as shown in FIGS. 2 and 7, the TPA cap 104 is mounted deeper onto and locked in place on the housing 106, the TPA leg 306 passes through the TPA leg aperture 314 forming a water-tight seal with the TPA leg aperture 314, and the distance 502 is decreased. The distance 502 may be decreased by any suitable amount, including, but not limited to, reduction of the distance 502 to about zero such that the TPA cap 104 is mounted deeper onto the housing 106 by a value about equal to the distance 502 of the pre-loaded configuration.

The TPA cap 104 may be formed of any suitable material, including, but not limited to, injection molded materials, including, but not limited to, polyamides, PA66, polybutylene terephthalates, liquid-crystal polymers or combinations thereof. The housing 106 may be formed of any suitable material, including, but not limited to, polyamides, PA66, polybutylene terephthalates, liquid-crystal polymers or combinations thereof. The rear wire seal 300 may be formed of any suitable material, including, but not limited to, silicone rubbers, inherently lubricated silicone rubbers, fluorosilicon rubbers, or combinations thereof.

As used herein, "water-tight" indicates a seal which offers protection from ingress of dust and ingress of water at 1 meter. In one embodiment, "water-tight" meets or exceeds the standards for an Ingress Protection rating (International Electrotechnical Commission) of at least IP-67, alternatively at least IP-68.

Figure 3:
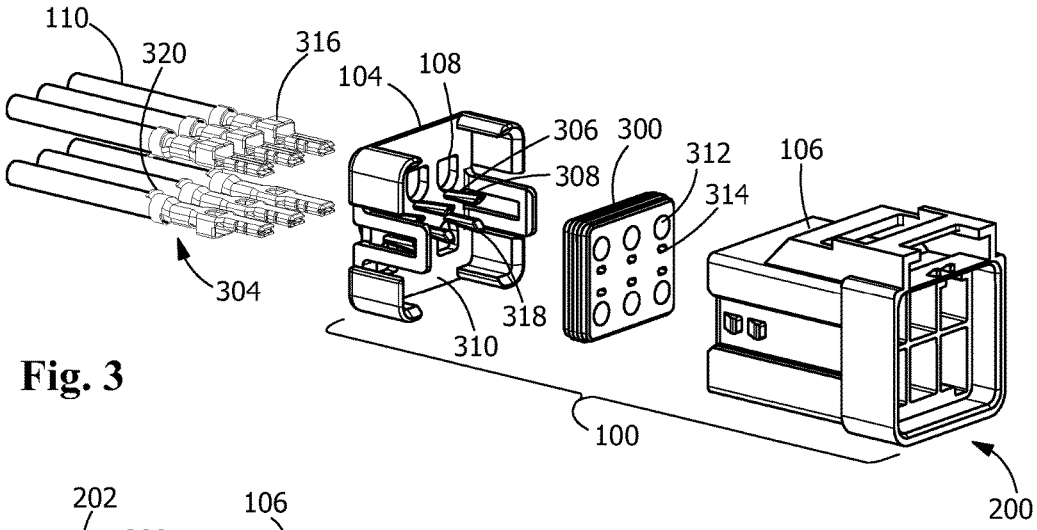
FIG. 3 is an exploded perspective view of the receptacle connector of FIG. 1, according to an embodiment of the disclosure.
Figure 4:
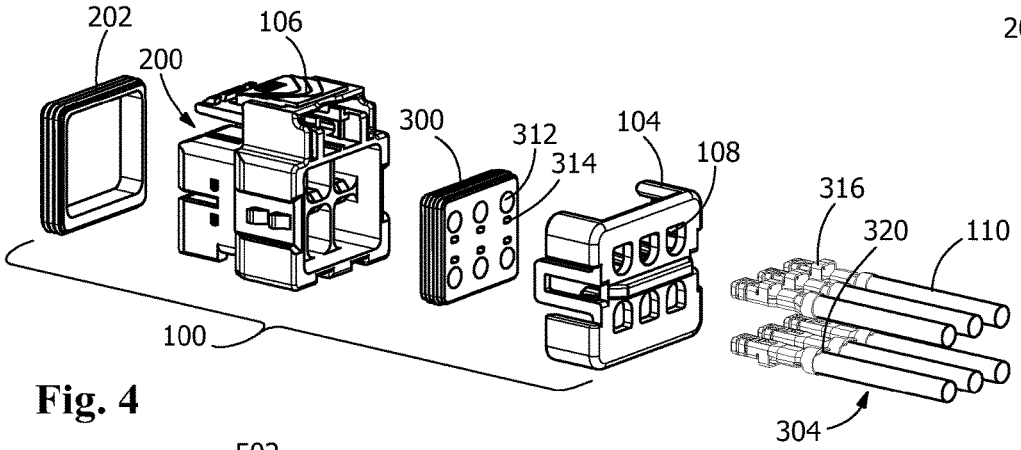
FIG. 4 is an exploded perspective view of the plug connector of FIG. 1, according to an embodiment of the disclosure.

The aperture 108 may include any suitable shape, but not limited to, a keying shape, as shown in FIGS. 3 and 4. In one embodiment, wherein the aperture 108 includes a keying shape, the wire-crimped terminal 304 also includes the keying shape.

The connector 102 may include any suitable number of apertures 108, TPA legs 306, wire apertures 312, TPA leg apertures 314 and positioning surfaces 900. In one embodiment, the connector 102 includes only a single aperture 108, TPA leg 306, wire aperture 312, TPA leg aperture 314, positioning surface 900, or combinations thereof. In another embodiment, the connector 102 includes a plurality of apertures 108, TPA legs 306, wire apertures 312, TPA leg apertures 314 and positioning surfaces 900. The plurality may be any suitable number, including, but not limited to, two, three, four, five, six (shown), seven, eight, nine, or ten. In one embodiment, the connector 102 includes an equal number of apertures 108, TPA legs 306, wire apertures 312, TPA leg apertures 314 and positioning surfaces 900. In another embodiment, the connector 102 includes a lesser number of apertures 108 than, individually, TPA legs 306, wire apertures 312, TPA leg apertures 314 and positioning surfaces 900.

Figure 12:
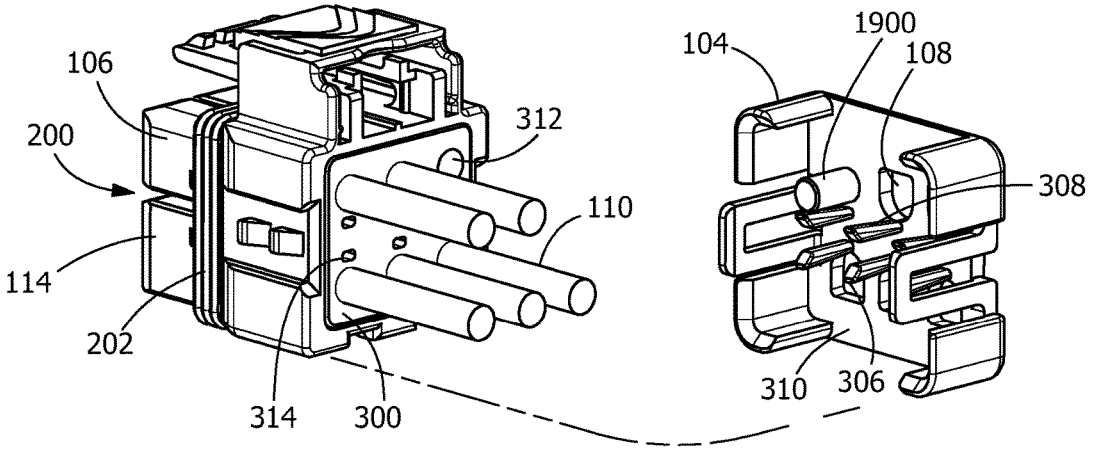
FIG. 12 is an exploded perspective view of a plug connector of FIG. 1 with an open aperture, according to an embodiment of the disclosure.
Figure 13:
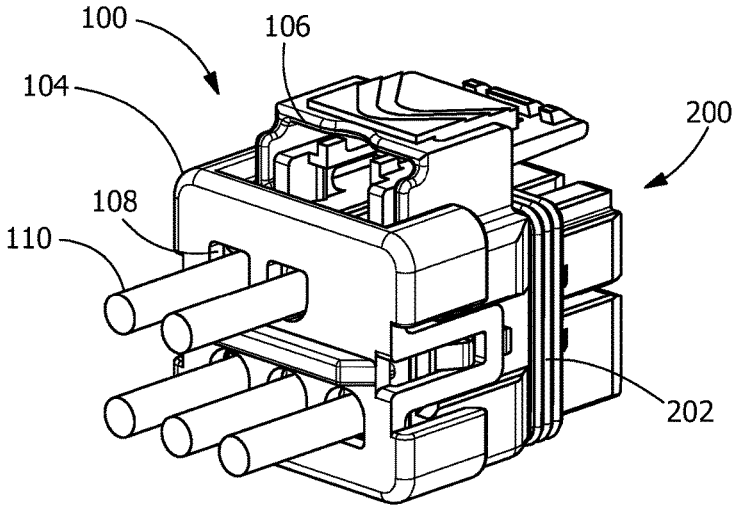
FIG. 13 is an assembled perspective view of the plug connector of FIG. 12, according to an embodiment of the disclosure.

Referring to FIGS. 12 and 13, in one embodiment, in which the connector 102 includes a lesser number of apertures 108 than, individually, TPA legs 306, wire apertures 312, TPA leg apertures 314 and positioning surfaces 900, the TPA cap 104 includes at least one sealing protrusion 1900 which, in the loaded configuration 112, extends into at least one of the plurality of wire apertures 312, forming a wire-free water-tight seal with the at least one of the plurality of wire apertures 312. In a further embodiment, the connector 102 includes an equal number of sealing protrusions 1900 as the difference between the number of apertures 108 and the number, individually, of TPA legs 306, wire apertures 312, TPA leg apertures 314 and positioning surfaces 900.

In various embodiments, the assembly 100 may include an interface seal 202 disposed thereon, and in an alternate further embodiment, the receptacle connector 116 includes the interface seal 202 disposed thereon. The interface seal 202 may be formed of any suitable material, including, but not limited to, silicone rubbers, inherently lubricated silicone rubbers, fluorosilicon rubbers, or combinations thereof.

In one embodiment (as illustrated in FIG. 7, by way of example), a sealed rear-loaded electrical connector housing assembly includes the connector assembly 100 and the wire-crimped terminal 304 disposed in the connector assembly 100. The wire-crimped terminal 304 includes the wire 110 and a terminal 316. The terminal 316 directly contacts the positioning surface 900 and the wire 110 passes through the aperture 108 and the wire aperture 312. In the pre-loaded configuration, the wire-crimped terminal 304 is removable from and insertable into the connector assembly 100. In the loaded configuration or fully assembled, the wire-crimped terminal 304 is locked in place by a locking surface 318 of the TPA leg 306 directly abutting a locking feature 320 of the terminal 316, the wire 110 directly contacts the wire support surface 308 and the wire 110 forms a wire water-tight seal with the wire aperture 312. When the connector assembly 100 is mated to a second connector assembly, the interface seal 202 forms a water-tight seal between the mating interfaces 200 of the connector assemblies 100. In a mated configuration, as shown in FIG. 7, in which the TPA cap 104 is fully inserted and the connector assemblies 100 are mated together and a water-tight connection is formed in which all exposed electrically conductive surfaces of the wire-crimped terminal 304 are disposed.

The mating interface 200 may be the mating interface 200 of another connector assembly 100, a wire, a powered circuit board receptacle, a panel mount, a twist and lock connector, or combinations thereof.

Figure 9:
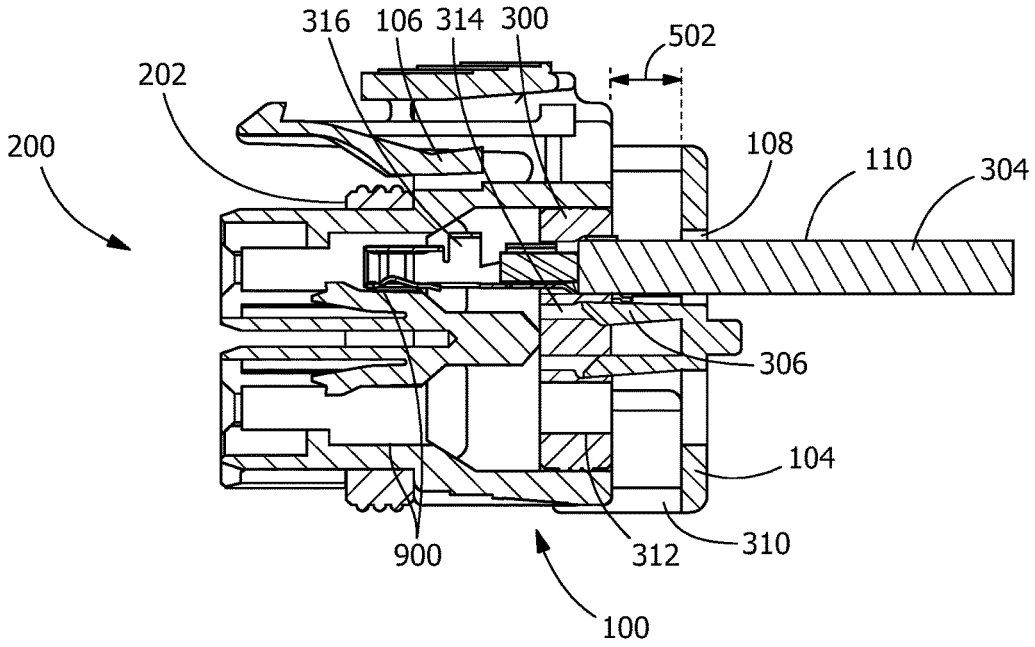
FIG. 9 is a cross-sectional view of the plug connector of FIG. 1 in a pre-loaded configuration while disconnected with a partially-inserted wire-crimped terminal, according to an embodiment of the disclosure.
Figure 10:
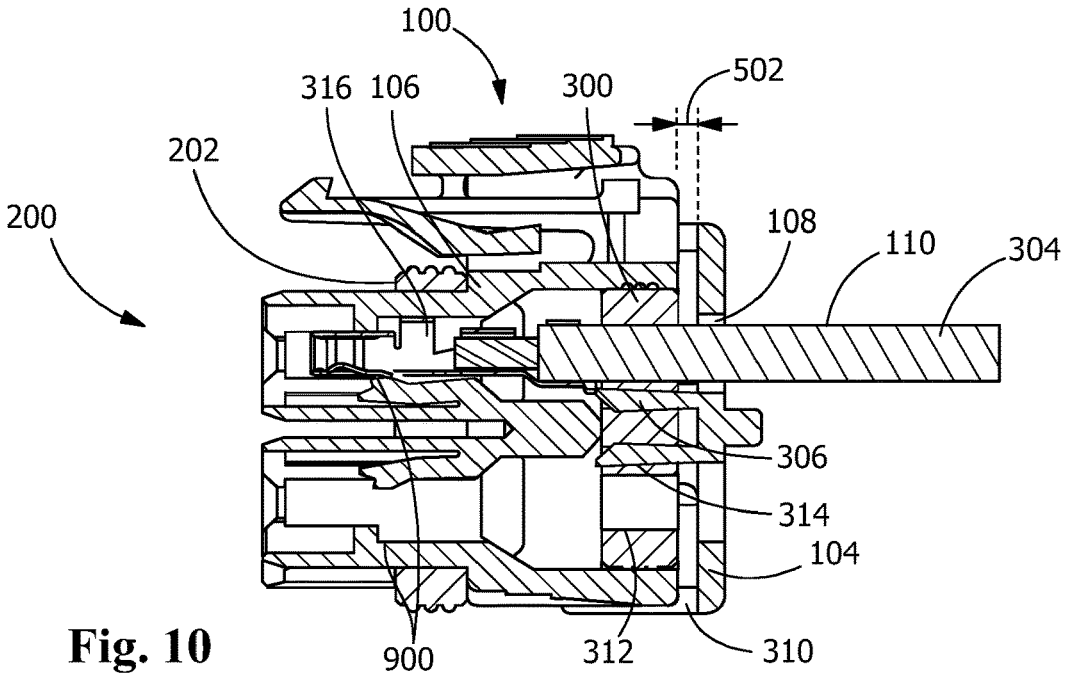
FIG. 10 is a cross-sectional view of the plug connector of FIG. 9 transitioning from a pre-loaded configuration to a loaded configuration, according to an embodiment of the disclosure.
Figure 11:
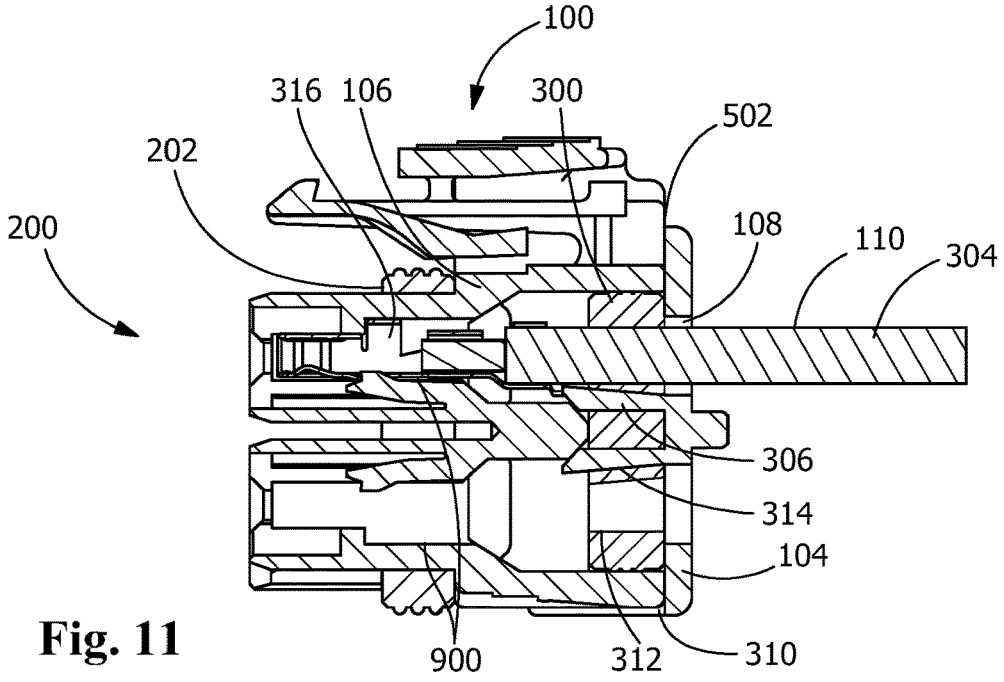
FIG. 11 is a cross-sectional view of the plug connector of FIG. 10 in a loaded configuration with the wire-crimped terminal fully inserted, according to an embodiment of the disclosure.

Referring to FIGS. 9-11, in one embodiment, the TPA leg 306 includes sufficient flexibility such that in the pre-loaded position, the wire-crimped terminal 304 may pass through the wire aperture 312, exerting a force on the TPA leg 306 as the wire-crimped terminal 305 slides past by the TPA leg 306, deflecting the TPA leg 306 away from the wire-crimped terminal 304 (FIG. 9) until a locking feature 320 of a terminal 316 of the wire-crimped terminal 304 is past the TPA leg 306, and sufficient resilience such that when the locking feature 320 is past the TPA leg 306, the TPA leg 306 deflects toward the wire-crimped terminal 304. As the TPA is moved from the pre-loaded position to the assembled position, the TPA cap 104 mounts deeper onto the housing 106 such that the locking surface 318 of the TPA leg 306 comes into contact with the locking feature 320 of the terminal 316 (FIG. 11) and locks the wire-crimped terminal 304 in place, fully inserted. If the wire-crimped terminal 304 is not fully inserted when the locking surface 318 of the TPA leg 306 comes into contact with the locking feature 320 of the terminal 316 (FIG. 10), completing the mounting of the TPA cap 104 onto the housing 106 in the loaded configuration 112 pushes the wire-crimped terminal 304 to be fully inserted (FIG. 11).

The TPA leg 306 may widen as the TPA leg 306 extends from the interior surface 310, may narrow as the TPA leg 306 extends from the interior surface 310, or may maintain the same cross-sectional area as the TPA leg 306 extends from the interior surface 310. In one embodiment, the shape of the TPA leg 306 as it extends from the interior surface 310 promotes the flexibility for the TPA leg 306 to deflect away from the wire-crimped terminal 304 while passing through the wire aperture 312, and promotes the resilience of the TPA leg 306 to deflect toward the wire-crimped terminal 304 after the locking feature 320 is past the TPA leg 306. The TPA leg 306 may have any suitable length, including, but not limited to, a length of between about 4 mm to about 8 mm, alternatively between about 5 mm to about 7 mm, alternatively between about 5.5 to about 6.5 mm. The TPA leg 306 may have any suitable thickness, including, but not limited to, a thickness of about 0.25 mm to about 1.5 mm, alternatively between about 0.5 mm to about 1.25 mm, alternatively between about 0.75 mm to about 1 mm. In one embodiment, the length to thickness ratio of the TPA leg 306 is between about 3:1 to about 15:1, alternatively between about 4:1 to about 12:1, alternatively between about 5:1 to about 9:1, alternatively between about 6:1 and about 7:1. The length to thickness ratio of the TPA leg 306 along with the material composition of the TPA leg 306 may contribute to the flexibility of the TPA leg 306 to deflect away from the wire-crimped terminal 304 while passing through the wire aperture 312 and the resilience of the TPA leg 306 to deflect toward the wire-crimped terminal 304 after the locking feature 320 is past the TPA leg 306.

Referring again to claims 1-18, the connector assembly 100 may include any suitable number of wire-crimped terminals 304. In one embodiment, the connector assembly 100 includes only a single wire-crimped terminal 304. In another embodiment, the connector assembly 100 includes a plurality of wire-crimped terminals 304. The plurality may be any suitable number, including, but not limited to, two, three, four, five, six, seven, eight, nine, or ten.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A sealed rear-loaded electrical connector assembly, comprising:

a connector housing, the housing including a positioning surface adapted to support and orient wire-crimped terminals positioned in the housing;

a terminal position assurance (TPA) cap, the TPA cap including:

apertures adapted to receive the wire-crimped terminals; and

TPA legs having wire support surfaces adapted to support wires of the wire-crimped terminals, the TPA legs extending from an interior surface of the TPA cap;

a rear wire seal, the rear wire seal including:

wire apertures adapted to receive the wire-crimped terminals; and

TPA leg apertures adapted to receive the TPA legs;

wherein, in a pre-loaded configuration, the rear wire seal is positioned between the housing and the TPA cap, the TPA cap is mounted onto the housing with the apertures of the TPA cap aligned with the wire apertures of the rear wire seal, and the TPA legs are disposed at least partially in the TPA leg apertures, and wherein, in a fully loaded configuration, the TPA cap is mounted deeper onto and locked in place on the housing, and the TPA legs pass through the TPA leg apertures forming a water-tight seal with the TPA leg apertures.

2. The sealed rear-loaded electrical connector assembly of claim 1, wherein an equal number of apertures of the TPA cap, wire apertures of the rear wire seal apertures, wire-crimped terminals and TPA legs are provided.

3. The sealed rear-loaded electrical connector assembly of claim 1, wherein the TPA cap includes at least one sealing protrusion which, in the loaded configuration, extends into at least one of the wire apertures, forming a wire-free water-tight seal with the at least one of the wire apertures.

4. The sealed rear-loaded electrical connector assembly of claim 1, wherein the TPA legs include sufficient flexibility such that in the pre-loaded configuration, the wire-crimped terminals may pass through the wire apertures, deflecting the TPA legs away from the wire-crimped terminals until locking features of terminals of the wire-crimped terminals are past the TPA legs, and sufficient resilience such that when the locking features are past the TPA legs, the TPA legs deflect toward the wire-crimped terminals.

5. The sealed rear-loaded electrical connector assembly of claim 1, wherein the apertures of the TPA cap include keying shapes.

6. The sealed rear-loaded electrical connector assembly of claim 1, wherein the TPA legs widen as the TPA legs extend from the interior surface.

7. A sealed rear-loaded electrical connector assembly, comprising:

a connector housing, the housing including a positioning surface adapted to support and orient keyed wire-crimped terminals positioned in the housing;

a terminal position assurance (TPA) cap, the TPA cap including:

apertures adapted to receive the keyed wire-crimped terminals, the apertures are keyed to cooperate with respective terminals of the keyed wire-crimped terminals; and TPA legs having wire support surfaces adapted to support wires of the wire-crimped terminals, the TPA legs extending from an interior surface of the TPA cap;

a rear wire seal, the rear wire seal including:

wire apertures adapted to receive the wire-crimped terminals; and

TPA leg apertures adapted to receive the TPA legs;

wherein, in a fully loaded configuration, the TPA legs pass through the TPA leg apertures forming a water-tight seal with the TPA leg apertures, the wire-crimped terminals are locked in place by locking surfaces of the TPA legs directly abutting the wire-crimped terminals, the wires of the wire-crimped terminals directly contact the wire support surfaces, and the wires form wire water-tight seals with the wire apertures.

8. The sealed rear-loaded electrical connector assembly of claim 7, wherein the connector assembly is a plug connector assembly and the housing includes the interface seal disposed thereon.

9. The sealed rear-loaded electrical connector assembly of claim 7, wherein the connector assembly is a receptacle connector assembly and the housing includes the interface seal disposed thereon.

10. The sealed rear-loaded electrical connector assembly of claim 7, wherein an equal number of apertures of the TPA cap, wire apertures of the rear wire seal apertures, wire-crimped terminals and TPA legs are provided.

11. The sealed rear-loaded electrical connector housing assembly of claim 10, wherein the TPA cap includes at least one sealing protrusion which, in the loaded configuration, extends into at least one of the wire apertures, forming a wire-free water-tight seal with the at least one of the wire apertures.

12. The sealed rear-loaded electrical connector housing assembly of claim 7, wherein the TPA legs include sufficient flexibility such that in the pre-loaded configuration, the wire-crimped terminals may pass through the wire apertures, deflecting the TPA legs away from the wire-crimped terminals until locking features of terminals of the wire-crimped terminals are past the TPA legs, and sufficient resilience such that when the locking features are past the TPA legs, the TPA legs deflect toward the wire-crimped terminals.

13. The sealed rear-loaded electrical connector housing assembly of claim 7, wherein the TPA legs widen as the TPA legs extend from the interior surface.

14. A sealed rear-loaded electrical connector assembly, comprising:

a connector housing, the housing including a positioning surface adapted to support and orient wire-crimped terminals positioned in the housing;

a terminal position assurance (TPA) cap, the TPA cap including:

apertures adapted to receive the wire-crimped terminals; and

TPA legs having wire support surfaces adapted to support wires of the wire-crimped terminals, the TPA legs extending from an interior surface of the TPA cap, the TPA legs widen as the TPA legs extend from the interior surface;

a rear wire seal, the rear wire seal including:

wire apertures adapted to receive the wire-crimped terminals; and

TPA leg apertures adapted to receive the TPA legs;

wherein, in a fully loaded configuration, the TPA legs pass through the TPA leg apertures forming a water-tight seal with the TPA leg apertures, the wire-crimped terminals are locked in place by locking surfaces of the TPA legs directly abutting the wire-crimped terminals, the wires of the wire-crimped terminals directly contact the wire support surfaces, and the wires form wire water-tight seals with the wire apertures.

15. The sealed rear-loaded electrical connector assembly system of claim 14, wherein the connector housing is a plug connector housing.

16. The sealed rear-loaded electrical connector assembly system of claim 14, wherein the connector housing is a receptacle connector.

17. The sealed rear-loaded electrical connector assembly of claim 14, wherein an equal number of apertures of the TPA cap, wire apertures of the rear wire seal apertures, wire-crimped terminals and TPA legs are provided.

18. The sealed rear-loaded electrical connector assembly of claim 14, wherein the TPA cap includes at least one sealing protrusion which, in the loaded configuration, extends into at least one of the wire apertures, forming a wire-free water-tight seal with the at least one of the wire apertures.

19. The sealed rear-loaded electrical connector assembly of claim 14, wherein the TPA legs include sufficient flexibility such that in the pre-loaded configuration, the wire-crimped terminals may pass through the wire apertures, deflecting the TPA legs away from the wire-crimped terminals until locking features of terminals of the wire-crimped terminals are past the TPA legs, and sufficient resilience such that when the locking features are past the TPA legs, the TPA legs deflect toward the wire-crimped terminals.

20. The sealed rear-loaded electrical connector assembly of claim 14, wherein the apertures of the TPA cap include keying shapes.

* * * * *